US006732491B2

(12) United States Patent
Buchman

(10) Patent No.: US 6,732,491 B2
(45) Date of Patent: May 11, 2004

(54) METHODS OF MANUFACTURING RECLOSABLE PACKAGE HAVING SLIDER DEVICE

(75) Inventor: James E. Buchman, Hortonville, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 0 days.

(21) Appl. No.: 10/379,498

(22) Filed: Mar. 4, 2003

(65) Prior Publication Data

US 2003/0145559 A1 Aug. 7, 2003

Related U.S. Application Data

(60) Continuation of application No. 09/895,541, filed on Jun. 28, 2001, now Pat. No. 6,581,358, which is a division of application No. 09/467,854, filed on Dec. 20, 1999, now Pat. No. 6,293,896.

(60) Provisional application No. 60/164,531, filed on Nov. 10, 1999.

(51) Int. Cl.[7] ..... B65B 61/18

(52) U.S. Cl. ..... 53/412; 53/479; 53/450; 53/133.4; 493/394; 493/213

(58) Field of Search ..... 53/412, 450, 479, 53/133.4, 139.2; 493/213, 214, 927, 394

(56) References Cited

U.S. PATENT DOCUMENTS

| | | | | |
|---|---|---|---|---|
| 3,246,444 | A | 4/1966 | Paisley | 53/412 |
| 3,426,396 | A | 2/1969 | Laguerre | 24/201 |
| 3,607,534 | A | 9/1971 | Gutman | 156/269 |
| 3,701,191 | A | 10/1972 | Laguerre | 29/207.5 |
| 3,701,192 | A | 10/1972 | Laguerre | 29/207.5 |
| 3,839,128 | A | 10/1974 | Arai | 156/583 |
| 4,437,293 | A | 3/1984 | Sanborn, Jr. | 53/412 |
| 4,528,224 | A | 7/1985 | Ausnit | 428/36 |
| 5,036,643 | A | 8/1991 | Bodolay | 53/128.1 |
| 5,247,781 | A | 9/1993 | Runge | 53/412 |
| 5,301,394 | A | 4/1994 | Richardson et al. | 24/399 |
| 5,431,760 | A | 7/1995 | Donovan | 156/66 |
| 5,519,982 | A | 5/1996 | Herber et al. | 53/412 |
| 5,713,669 | A | 2/1998 | Thomas et al. | 383/204 |
| 5,788,378 | A | 8/1998 | Thomas | 383/63 |
| 5,816,018 | A | 10/1998 | Bois | 53/133.4 |
| 5,938,337 | A | 8/1999 | Provan et al. | 383/5 |
| 5,947,603 | A | 9/1999 | Tilman | 383/64 |
| 5,956,924 | A | 9/1999 | Thieman | 53/412 |

FOREIGN PATENT DOCUMENTS

| | | |
|---|---|---|
| GB | 2 254 038 A | 9/1992 |
| JP | 404311411 A | 11/1992 |

*Primary Examiner*—Mickey Yu
*Assistant Examiner*—Sameh Tawfik
(74) *Attorney, Agent, or Firm*—Tracey D. Beiriger

(57) ABSTRACT

A method of making packages having a reclosable zipper construction openable and closable by a slider device, on a horizontal form, fill and seal process. The method includes applying the slider device to the zipper construction prior to incorporating the zipper construction with side panels to form the package. A tamper-evident seal may be provided encasing the slider device to provide indication whether access has been gained to the interior of the package.

11 Claims, 12 Drawing Sheets

METHODS OF MANUFACTURING RECLOSABLE PACKAGE HAVING SLIDER DEVICE

CROSS REFERENCE TO RELATED APPLICATIONS

This application is a continuation of U.S. Ser. No. 09/895,541, filed Jun. 28, 2001 now U.S. Pat. No. 6,581,358, which is a division of application U.S. Ser. No. 09/467,854, filed on Dec. 20, 1999 now U.S. Pat. No. 6,293,896, which application claims benefit of provisional U.S. Serial No. 60/164,531, filed on Nov. 10, 1999.

FIELD OF THE DISCLOSURE

This disclosure concerns reclosable packages. In particular, this disclosure describes reclosable packages manufactured from form, fill, and seal machines, the packages having slider devices for opening and closing the packages, and methods of manufacturing the packages.

BACKGROUND

Form, fill, and seal technology is known in the packaging industry as a method to package consumable goods. Consumable goods that are not used completely when the package is initially opened rely on a zipper closure to reclose the package and keep the remaining contents fresh. Examples of consumable goods that are often packaged in packages with a zipper closure include potting soil, fertilizer, pet food, dog biscuits, and many different foods edible by humans.

Often, the opening and closing of the zipper closure is facilitated by a slider device that is mounted on the zipper closure. The slider device is constructed to pry apart the interlocking zipper closure members when the slider device is moved in a first direction along the zipper, and to engage the interlocking zipper closure members when the slider device is moved in a second, opposite direction along the zipper. For some applications, a tamper-evident seal, to notify whether access has been gained to the zipper closure, is desired. Improvements in these types of packages are desirable.

SUMMARY OF THE DISCLOSURE

The present disclosure relates to a method of manufacturing a package, such as a flexible bag, having a resealable, reclosable zipper mechanism; opening and closing of which is accomplished by a slider device mounted on the zipper mechanism. A tamper-evident seal can be provided on the exterior or interior of the slider device so as to provide evidence whether access has been gained to the interior of the package. Alternately or additionally, a hermetic peel seal can be included in the package.

In particular, the present disclosure relates to a form, fill and seal process that manufactures the flexible package, fills the package with items, and seals the filled package. The zipper mechanism, the slider, and any seals are applied to the package in the same process as filling of the package.

The methods of this disclosure involve, in general, providing a zipper having interlocking closure members, incorporating a "park" notch within the zipper, locating the slider device within the "park" notch, attaching the zipper and slider to side panels as appropriate to provide a package.

In one particular embodiment, the present disclosure is directed to a method of manufacturing a reclosable package having a zipper closure and a slider device. The method includes providing a closure construction having a first closure profile and a second closure profile and providing a slider device. The slider device is constructed and arranged for mounting on the closure construction and for interlocking, the first closure profile with the second closure profile when the slider device is moved in a first direction, and for disengaging the first closure profile from the second closure profile when the slider device is moved in a second opposite direction. The slider device is mounted onto the closure construction, and the closure construction, with the slider device mounted thereon, is transported in a straight-line between a first film panel and a second film panel. The closure construction, together with the film panels, are formed into a resealable package.

This disclosure also relates to the resealable, reclosable packages made by the methods of this disclosure.

DETAILED DESCRIPTION

The addition of a slider device to a flexible package, such as a bag, is advantageous to aging or arthritic persons not having the physical ability to use just a zipper closure to reseal a bag. The process described herein adds a slider device to bags manufactured from form, fill, and seal machines. In some embodiments, a tamper-evident seal and/or a peel seal is also provided by the process described herein.

Figure 1:
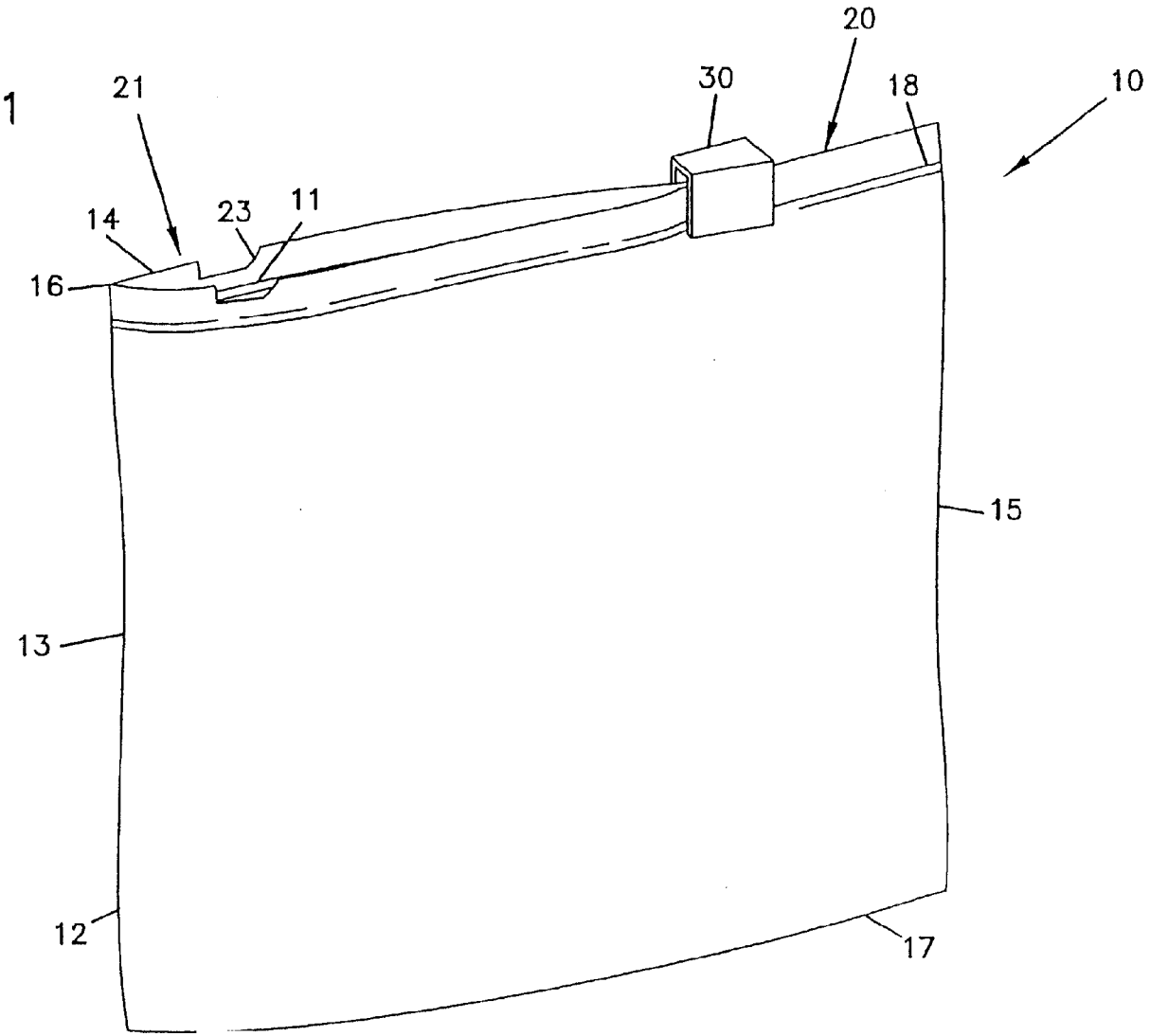
FIG. 1 is a perspective view of a flexible, reclosable package.
Figure 2:
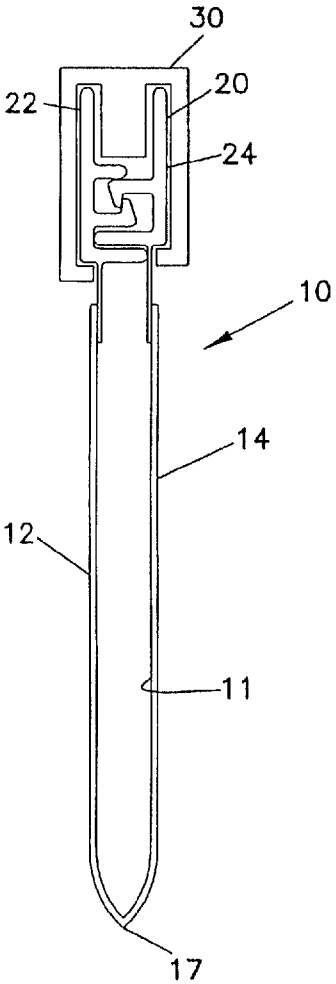
FIG. 2 is a schematic, cross-sectional view of a flexible, reclosable package similar to that depicted in FIG. 1.

A flexible, reclosable package 10 having side panels 12 and 14 defining interior 11 is shown in FIGS. 1 and 2. Side panels 12, 14 are sealed together at side seams 13, 15 and at bottom seam 17. A zipper closure arrangement having mating profiles to open and close (unseal and reseal) the bag 10 is shown at 20. The zipper closure 20 can include a variety of configurations and structures. For example, the zipper closure 20 can be constructed according to U.S. Pat. Nos. 4,240,241; 4,246,288; or 4,437,293; each of which is incorporated by reference herein. The zipper closure 20 includes a first mating profile 22 (FIG. 2) and a second mating profile 24 (FIG. 2) that engage and disengage, as appropriate, to open and close the bag 10. Zipper closure 20 extends from a first edge 16 of the bag 10 to a second edge 18 across a mouth 21.

A slider device 30 is mounted on zipper closure 20 to facilitate opening and closing zipper closure 20. Slider devices and how they function to open and close zipper closures, in general, are taught, for example, in U.S. Pat. Nos. 5,063,644; 5,301,394; 5,442,837, and 5,664,229, each of which is incorporated by reference herein. A notch 23 (FIG. 1) is disposed within zipper closure 20 adjacent to a first edge 16 in the bag 10. Notch 23 is designed to provide a "park place" into which slider device 30 settles when zipper closure 20 is sealed and slider device 30 is at the first edge 16. Such a notch 23 may decrease any tendency for an incomplete interlock between first mating profile 22 and second mating profile 24.

Figure 3:
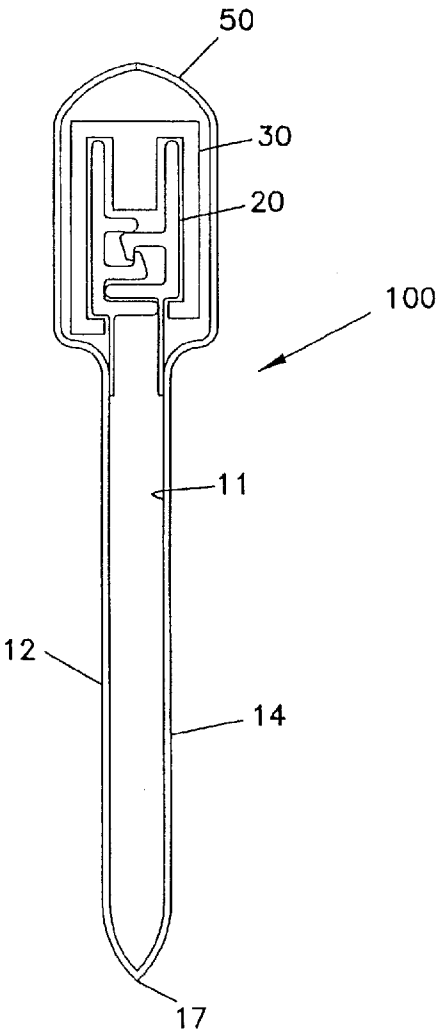
FIG. 3 is a schematic, cross-sectional view of a flexible, reclosable package having a tamper-evident seal.
Figure 5:
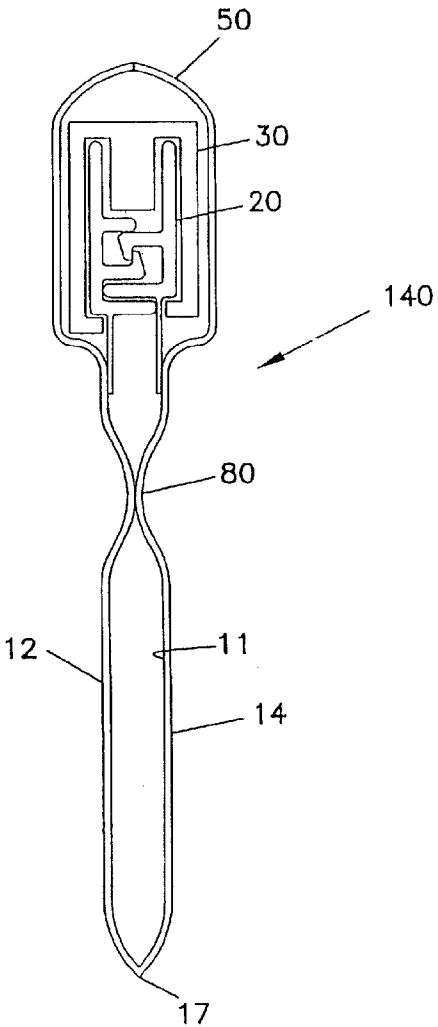
FIG. 5 is a schematic, cross-sectional view of a flexible, reclosable package having a tamper-evident seal and a peel seal.

FIG. 3 illustrates a flexible bag 100 similar to bag 10 of FIGS. 1 and 2, except that bag 100 includes a tamper-evident structure 50 disposed over slider device 30. By "tamper-evident", it is meant that it provides an indication to the consumer as to whether the package 100 has been previously opened. In order to access the interior 11 of the package 100, the tamper-evident structure 50 needs to be penetrated. In this embodiment, the tamper-evident structure 50 covers and forms a complete enclosure around the zipper closure 20 and slider device 30; tamper-evident structure 50 is formed by sealing the tops of side panels 12, 14 over slider device 30. In order to gain access to the slider device 30 and bag interior 11, the tamper-evident structure 50 needs to be penetrated. Various modifications of tamper-evident structures are known throughout the art of resealable packaging; additional examples of packages with tamper-evident structures are illustrated in FIGS. 4 and 5.

Figure 4:
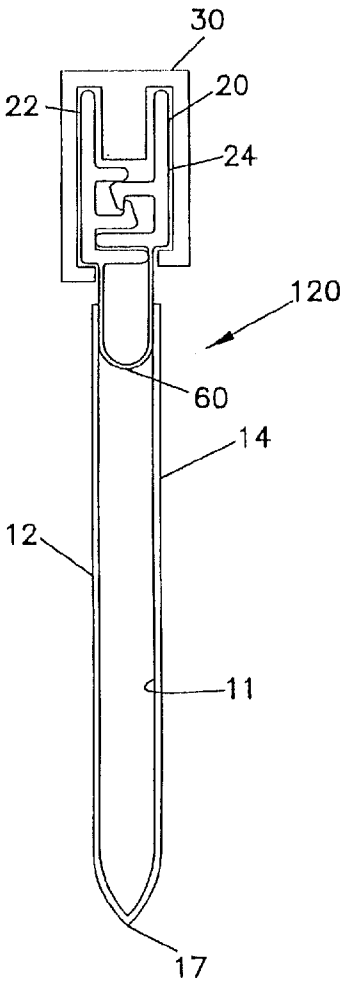
FIG. 4 is a schematic, cross-sectional view of another embodiment of a flexible, reclosable package having a tamper-evident seal.

FIG. 4 illustrates a flexible bag 120, similar to bag 10 of FIGS. 1 and 2 and bag 100 of FIG. 3, except that bag 120 has an internal tamper-evident structure 60 disposed between zipper closure 20 and the interior 11 of bag 120. In order to gain access into the interior 11 of bag 120, tamper-evident seal 60 needs to be penetrated. FIG. 5 shows a flexible bag 140 similar to bag 100 of FIG. 3, except that bag 140 also includes a peel seal 80 disposed between zipper closure 20 and the interior 11 of bag 140. Other embodiments of tamper-evident structures are described in U.S. Pat. No. 5,713,669, herein incorporated by reference.

Each of these bags described and disclosed in FIGS. 1 through 5 can be manufactured by a horizontal form, fill and seal machine in accordance with the present disclosure. The bag, whether with or without a tamper-evident seal and/or a peel seal, is manufactured, filled, and sealed by a single process that includes multiple sequential steps. The zipper closure 20, slider device 30 and any tamper-evident structure are applied to the bag prior to the bag being filled with items.

Figure 6:
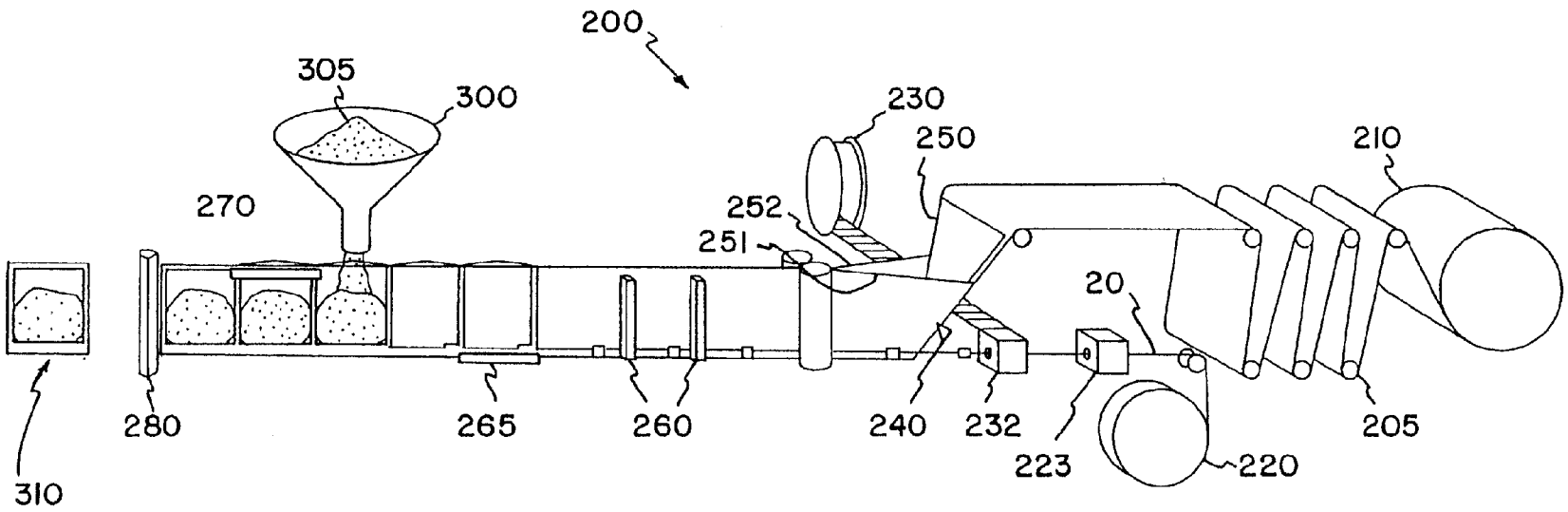
FIG. 6 is a schematic, perspective view of a horizontal form, fill, and seal machine for manufacturing and filling packages having a zipper closure and slider device attachment.
Figure 7:
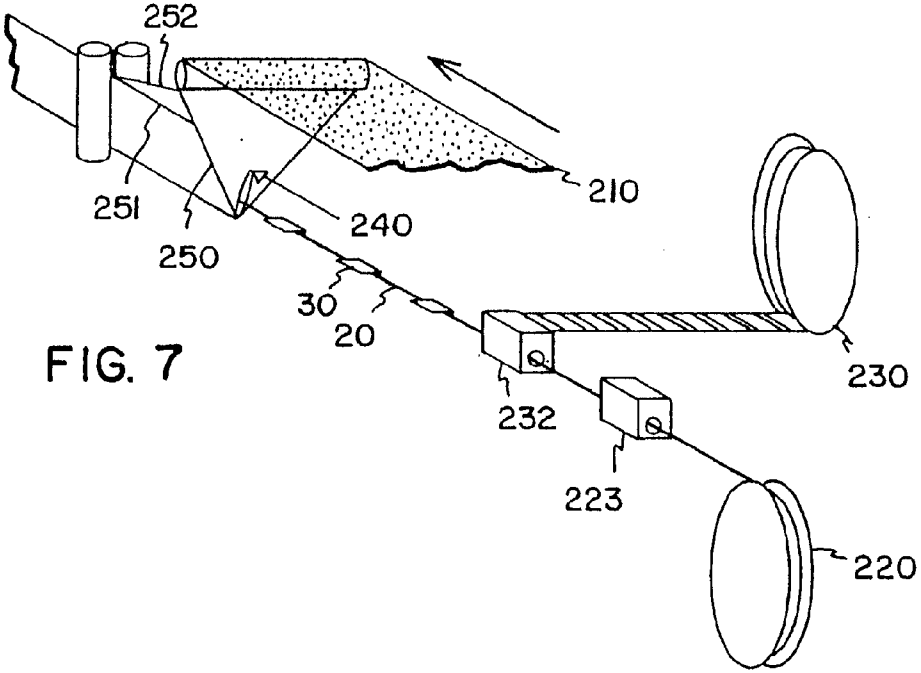
FIG. 7 is an enlarged schematic plan view of a portion of the process depicted in FIG. 6.

Referring to FIGS. 6 and 7, a horizontal form, fill and seal process, in accordance to the present disclosure, is shown at 200 in FIG. 6. As illustrated in FIGS. 6 and 7, the process line progresses from right to left; that is, the final filled package is at the left of the figures. The bag or package is manufactured upside-down so that the filling takes place through the bottom of the bag. Throughout this disclosure, the side of the bag having the zipper closure will be referred to as the "top" of the bag.

Polymeric film 210, which will provide the side panels 12, 14 (FIGS. 1 through 5), is provided on a roll. In another embodiment, film 210 may be extruded or otherwise formed immediately before this horizontal form, fill and seal process, thereby eliminating the step of winding the film after forming and then unwinding when the bags are made and filled. A series of tensioners 205 (FIG. 6) helps to control the tension on the film 210 during the bag-making process. From the tensioners 205, the film progresses to a "V-board" 250 where the film 210 is folded. A slitter knife 240 close to the base of the V-board 250 slits film 210 into two webs of film 251, 252. Additional features of the V-board 250 are discussed below.

An extended length of zipper closure 20 (with first closure profile and second closure profile interlocked) is provided via spool 220 simultaneously with the film 210. Notch 23 (FIG. 1) is punched into zipper closure 20 by an in-line punch 223 that may be a die, knife, stamp or other such process. Notch 23 is formed in the profile of the zipper closure 20 before the zipper closure 20 is incorporated into the package. Referring still to FIGS. 6 and 7, slider device 30, provided from a spool 230, is parked into the notch 23 punched in zipper closure 20 by applicator 232. If misaligned on the zipper closure 20 or notch 23, the slider device 30 can be phased into register with the notch 23 by sliding or moving the slider device 30 along the zipper profile 20 by guides or the like, until the slider device is in register with the package slider "park" position, that is, notch 23.

The punching of notch 23 by punch 223 and the application of slider device 30 by applicator 232 may be done as a continuous procedure, that is, with zipper closure 20 being continuously unwound from spool 220 and applied to film halves 251, 252. Alternately, notch 23 and slider device 30 may be applied in a step-wise function; that is, zipper closure 20 can be incrementally indexed to punch 223 and to applicator 232. The zipper closure 20 would be indexed a distance generally equal to the width of the package from first edge 16 to the second edge 18 (FIG. 1). In such a process, it may be preferable to include various tensioner rolls to compensate for the incremental feeding of zipper closure 20 with the parked slider device 30 to the film halves 251, 252.

The zipper closure 20 with the parked slider device 30 is fed between the two halves 251, 252 of film 210. A pair of guides or fingers (not illustrated) may be used to spread apart film halves 251, 252 to allow easier passage of the combined zipper closure 20/slider device 30 therethrough. With this arrangement, the combined zipper closure 20 and slider device 30 can be fed between the film halves 251, 252 without having to progress through bends or around rollers. That is, the combined zipper closure 20 and slider device 30 is allowed to travel in a straight configuration from the point where slider device 30 is applied to the zipper closure 20 to the point where the combined zipper and slider are attached to film halves 251, 252. Preferably, once attached to film halves 251, 252, the straight configuration (i.e., with no bends or turns) is maintained.

V-board 250, as used in the method of the present disclosure, bends and configures film 210 into the desired form, and is instrumental in applying zipper closure 20 with the parked slider device 30 to the film halves 251, 252. Slitter knife 240, for slitting into film halves 251, 252, is positioned at or near the bottom of V-board 250.

Figure 8:
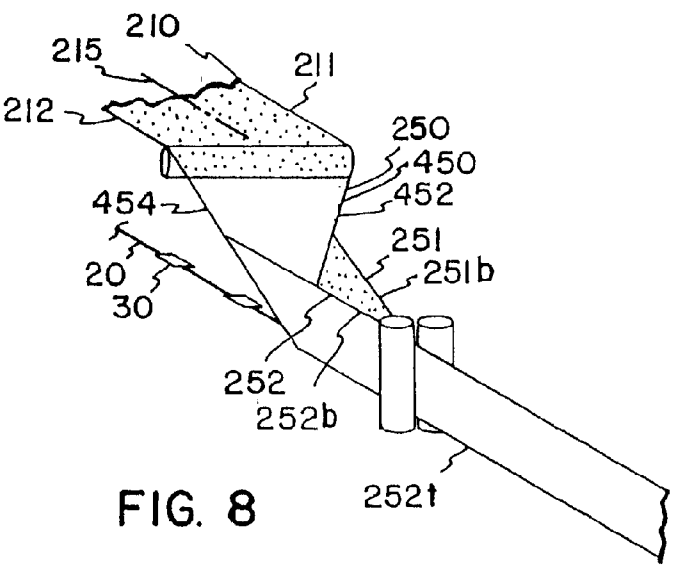
FIG. 8 is an enlarged schematic side view of a portion of the process depicted in FIGS. 6 and 7, viewed from the opposite side of FIGS. 6 and 7.

As illustrated in FIGS. 6, 7 and 8, V-board 250 is a generally two-dimensional board defined by a triangular face 450 with a top edge 451 and two angled edges 452, 454. Generally, the board is "v" shaped. A flat sheet of film 210 is folded into two halves by passing the film against the two angled edges 452, 454 of V-board 250. As best seen in FIG. 8, film 210 is brought behind the top edge 451 and face 450 of the board, and is then folded by the two angled edges 452, 454. The outer edges 211, 212 of film 210 form the bottom edges 251*b*, 252*b* of the film halves 251, 252, respectively, and the centerline 215 of film 210 forms the top edges of the resulting package. Film 210 is slit by slitter knife 240 at centerline 215 to provide top edges 251*t* (not illustrated), 252*t* of the two individual film halves 251, 252.

Preferably, V-board 250 includes a slot, slit, hole, or other aperture 255 (FIG. 7) through its face near the slitter knife 240 to accommodate passing the zipper closure 20 and slider device 30 therethrough. In accordance with the present disclosure, the zipper closure 20 is fed into slot 255 at the base of the V-board 250, preferably fairly soon after slitter knife 240 produces film halves 251, 252 from film 210. The slot 255 allows the zipper closure 20 be brought between the film halves 251, 252 without a need for bending or turning corners with zipper closure 20 with slider device 30.

Because the bag or package is manufactured upside-down (that is, the bottom seam 17 (FIGS. 1 through 5) will be at the top of the line, and the "top" of the bag is at the bottom of the line), the zipper closure 20, with the parked slider device 30, is positioned at the bottom of the film halves 251, 252.

Heated seal bars 260 provide vertical seals on the film and zipper closure combination. These vertical seals will eventually result in side seams 13, 15 of package 10 in FIG. 1. In one embodiment, a single heated seal bar 260 is used. In a second embodiment, a plurality of heated seal bars 260 is used. Typically, each seal bar 260 has a first bar and a second bar (not illustrated) on opposite sides of the film. Heat may be provided from one or both sides; additionally and/or alternatively, the temperature from one side to another may be the same or may be different. Multiple seal bars, such as shown in FIG. 6, may be heated to different temperatures. The process may be designed so that each seam area is contacted by multiple seal bars, or by only one bar. Rollers can be used as desired to feed and stabilize the film and zipper closure.

Top seal bar 265, positioned at the bottom of the line, seals zipper closure 20 to the film halves 251, 252. Zipper closure 20 has first closure profile 22 and second closure profile 24 interlocked (FIG. 2), so that that after the film halves 251, 252 are attached to the two closure profiles 22, 24, the package is ready to accept items or material into the interior 11 (FIGS. 1 through 5).

A tamper-evident structure, for example, structure 50 of FIG. 3 and structure 60 of FIG. 4, provides an indication to the consumer as to whether the package 100, 120 (FIGS. 3 and 4, respectively) has been previously opened. In order to access the interior 11 of the package 100, 120, the tamper-evident structure 50, 60 needs to be penetrated. This is typically accomplished by cutting and/or removing the structure 50, 60. In some embodiments, in particular with the tamper-evident structure 50 of FIG. 3, the structure 50 may include a scored or perforated area to aid in the removal of at least a portion of the tamper-evident structure 50.

Figure 9:
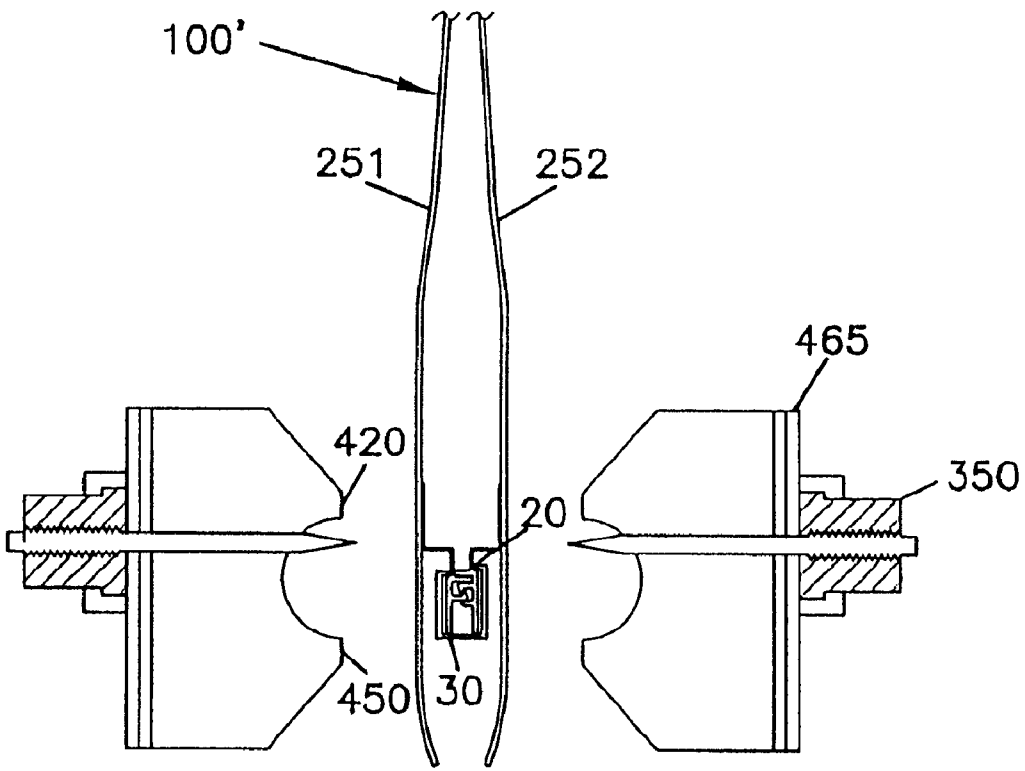
FIG. 9 is an enlarged schematic, cross-sectional view of a process for providing a perforated tamper-evident seal, such as for the packages of FIG. 3.

A tamper-evident structure, such as structure 50 of FIGS. 3 and 5, can be produced by modifications to top seal bar 265 of horizontal form, fill and seal process 200. For example, referring to FIG. 9, an unfinished package 100', similar to finished package 100 of FIG. 3, can be made by using a top seal bar 465 that has first sealing surfaces 420 and second sealing surfaces 450. Zipper closure 20, with slider device 30 mounted thereon, is positioned between film halves 251, 252. The two halves of seal bar 465 are brought together so that first sealing surfaces 420 and second sealing surfaces 450 contact the film halves 251, 252. First sealing surfaces 420 are positioned to provide pressure and, typically, heat to the area where the flanges of zipper closure 20 meet the film 251, 252, so as to make a seal between zipper closure 20 and the film. Second sealing surfaces 450 are positioned to provide pressure and, typically, heat to an area below slider device 30 and form a seal between film halves 251, 252. This will provide a tamper-evident structure 50 (shown in FIGS. 3 and 5 at the top of the package) which encases slider device 30.

An adjustable depth perforator 350 may be combined with seal bar 465 to provide perforations or some other weak point in the film between the area of the zipper closure/film seal and the area of the top film seal. This weakened area allows easy removal of the tamper-evident structure 50 by the consumer. Preferably, the weakened area is positioned close to the area where the zipper closure 20 is sealed to the film and the slider device 30, to minimize the amount of film remaining close to slider device 30 after the tamper-evident structure 50 is removed from the package.

Figure 13:
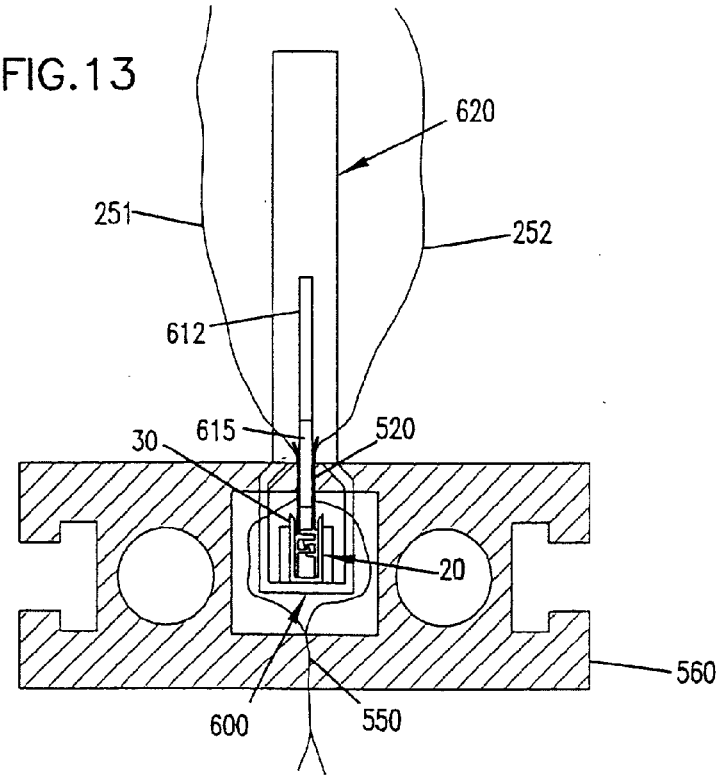
FIG. 13 is an enlarged schematic, cross-section view of a portion of another process for providing an external tamper-evident seal and an internal tamper-evident seal.
Figure 14:
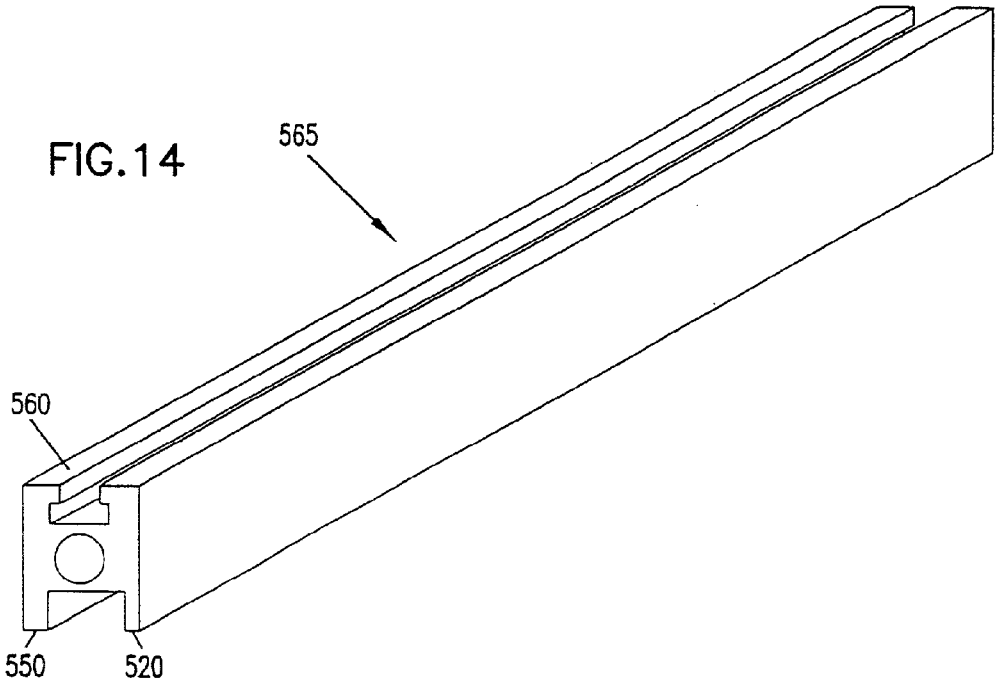
FIG. 14 is an enlarged perspective view of a portion of the process of FIG. 13.

Attention is now directed to FIGS. 13 through 16, which depict another embodiment of a horizontal seal bar 565, one that can be used with a slider guide 600. In FIGS. 13 and 14, seal bar 565 has first sealing surface 520, second sealing surface 550 and an outside surface 560. In FIG. 13, zipper closure 20, with slider device 30 mounted thereon, is positioned between film halves 251, 252. Similar to as described in reference to seal bar 465 of FIG. 9, two seal bars 565 are brought together so that first sealing surfaces 520 and second sealing surfaces 550 contact the film halves 251, 252. In FIG. 13, first sealing surfaces 520 are positioned to provide pressure and, typically, heat to the area where the flanges of zipper closure 20 meet the film halves 251, 252, so as to make a seal between zipper closure 20 and the film. Second sealing surfaces 550 are positioned to provide pressure and, typically, heat to an area below slider device 30 and form a seal between film halves 251, 252 to provide a tamper-evident structure 50 (shown in FIGS. 3 and 5 at the top of the package) which encases slider device 30.

Seal bar 565 is designed for use with slider guide 600, shown in FIG. 13 and in various views in FIGS. 15A through 15D. Slider guide 600 is constructed to protect zipper closure 20 and slider device 30 from first and second sealing surface 520, 550 of seal bar 565 (FIGS. 13 and 14) during forming of the various seals, and to provide an insert between film halves 251, 252 at first sealing surfaces 520.

Figure 16:
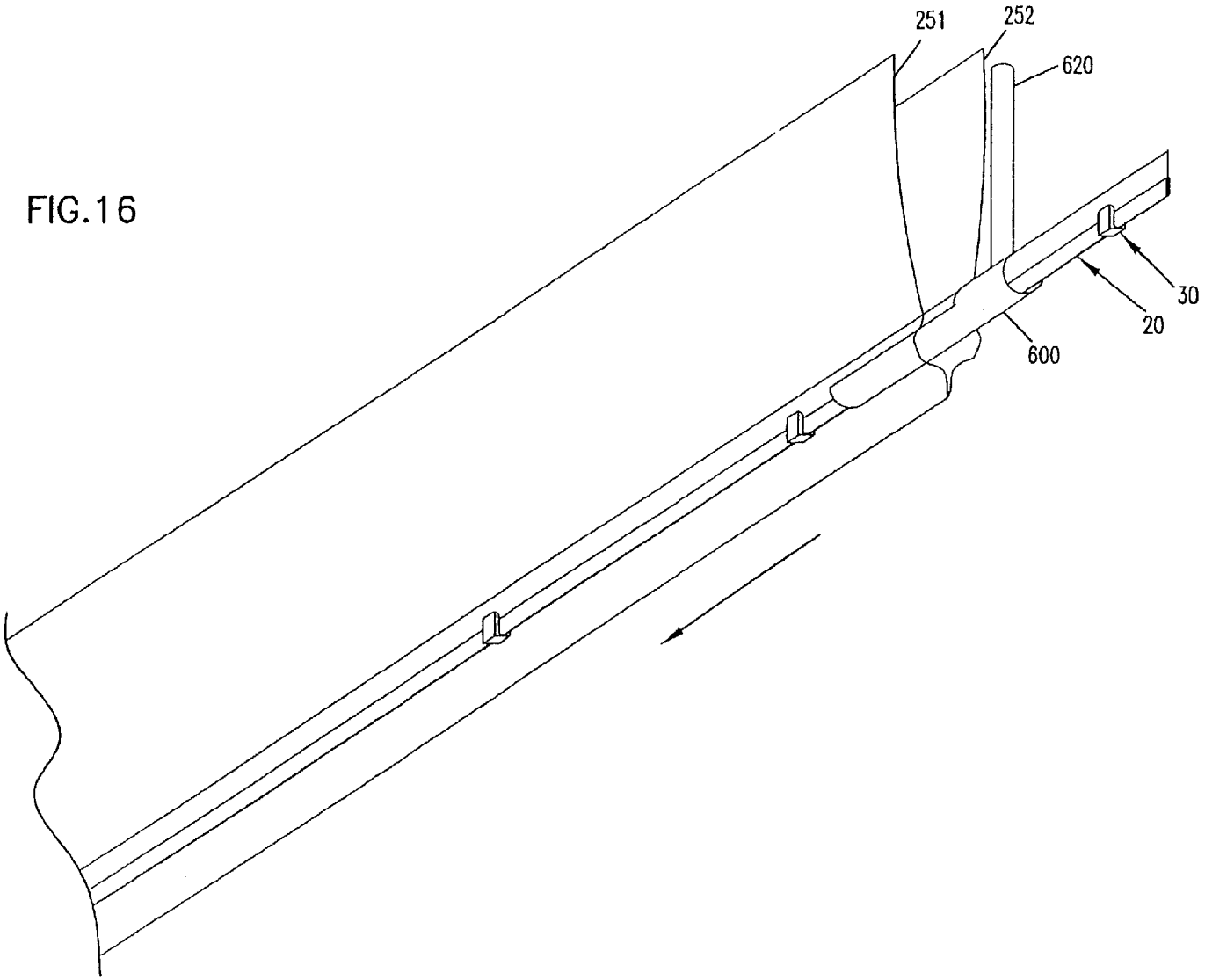
FIG. 16 is a schematic perspective view of another portion of the process of FIG. 13.

Slider guide 600 includes a generally tubular body 605 through which zipper closure 20 and slider device 30 can pass. A portion of the tubular body 605 is preferably removed, as best shown in FIG. 16, to facilitate sealing of film halves 251, 252 with seal bar 565, which is not shown in FIG. 16. First surface 520 of seal bar 565 contacts film halves 251, 252 in the removed region. Slider guide 600 is designed so that zipper closure 20, with slider device 30 thereon, moves from left to right through slider guide 600 in FIG. 15B.

Figure 15C:
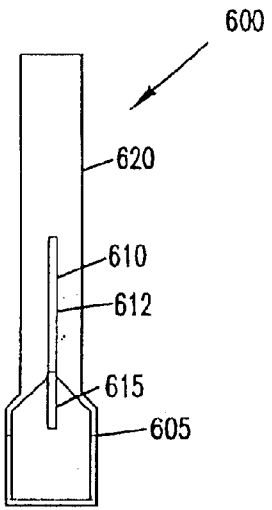
FIG. 15C is a rear view of the apparatus of FIG. 15A.
Figure 15B:
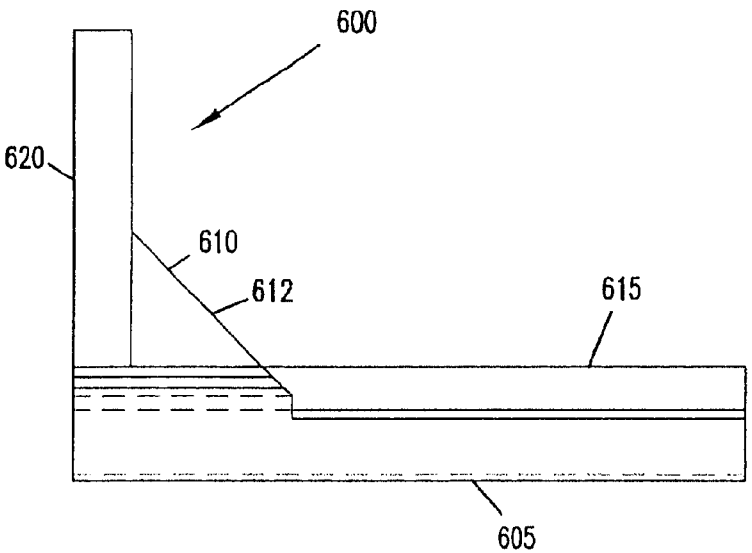
FIG. 15B is a side view of the apparatus of FIG. 15A.
Figure 15A:
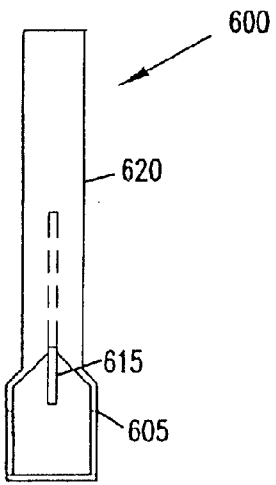
FIG. 15A is a front view of an apparatus for use with the process of FIG. 13.
Figure 15D:
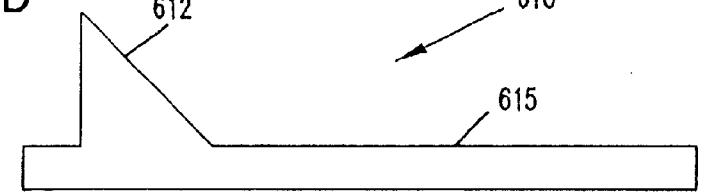
FIG. 15D is a side view of a portion of the apparatus of FIG. 15A, the portion being removed from the apparatus.

Slider guide 600 further includes a separating fin 610, best seen in FIG. 15D. Separating fin 610 includes a horizontal fin 615 and a gusset 612. When a zipper closure 20 is positioned within slider guide 600, horizontal fin 615 extends away from tube body 605 toward zipper closure 20 and separates zipper closure 20; that is, a portion of separating fin 610, in particular horizontal fin 615, is disposed between portions of first and second mating profiles 22, 24 (FIG. 2). Horizontal fin 615 facilitates sealing of film halves 251, 252 to first and second mating profiles 22, 24 by minimizing the occurrence of having first and second mating profiles 22, 24 seal to one another.

Separating fin 610 is attached to mounting member 620 of slider guide 600; mounting member 620 extends out from tubular body 605 and provides a mounting area for slider guide 600 as needed. A gusset 612 can be included on fin 610 to strengthen the attachment of fin 610 to mounting member 620.

FIG. 16 depicts the positioning of slider guide 600 in relation to film halves 251, 252, zipper closure 20 and slider device 30. The process progresses from right to left, as depicted by the arrow. Slider guide 600 would be positioned behind the V-board 250 shown in FIG. 7. Zipper closure 20 would pass through slot 255 and into slider guide 600. Alternately, slider guide 600 can be positioned within slot 255 in V-board 250, so that a portion of slider guide 600 is on the left of V-board 250 and a portion is on the right.

Figure 10:
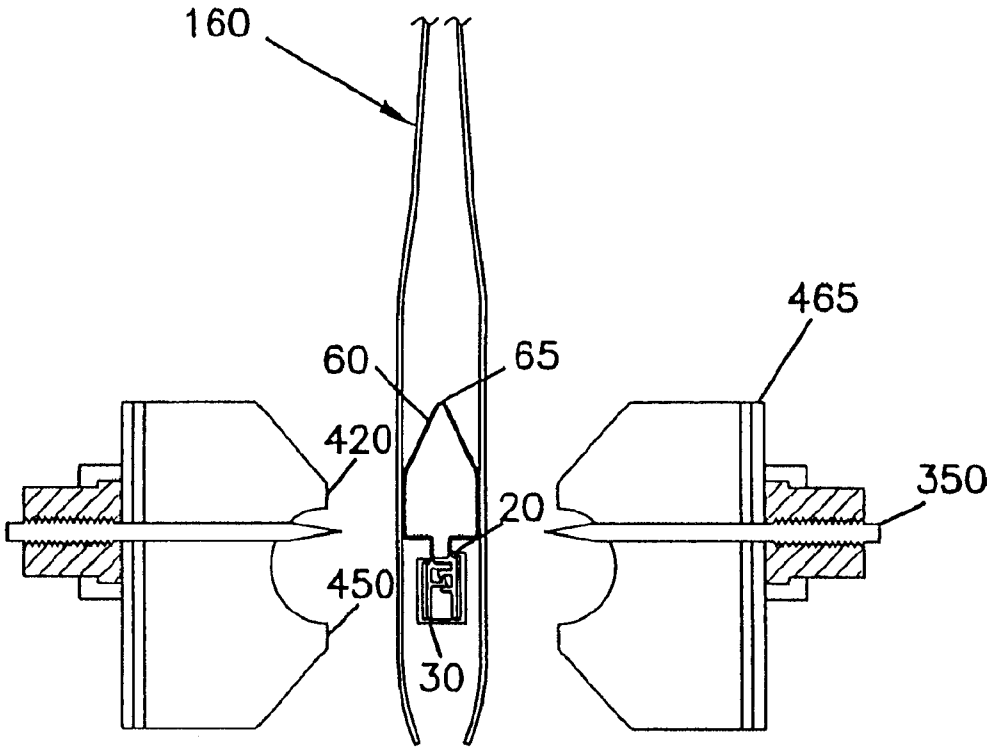
FIG. 10 is an enlarged schematic, cross-sectional view of a process for providing a perforated external tamper-evident seal and an internal tamper-evident seal.

FIG. 10 shows an unfinished package 160. Package 160 is similar to package 100' of FIG. 9, except that package 160 includes a second tamper-evident structure 60 internal to slider device 30 and zipper closure 20. Package 160 can be made using the seal bar 465 with first and second sealing surfaces 420, 450, and perforator 350, as discussed above, to form tamper-evident structure 50. Internal tamper-evident structure 60 can be integrally formed with first and second closure profiles 22, 24 (FIG. 2) when zipper closure 20 is extruded. A perforated line or a peel strip can be used at point 65 (FIG. 10) to allow for easy access to the bag interior.

Figure 11:
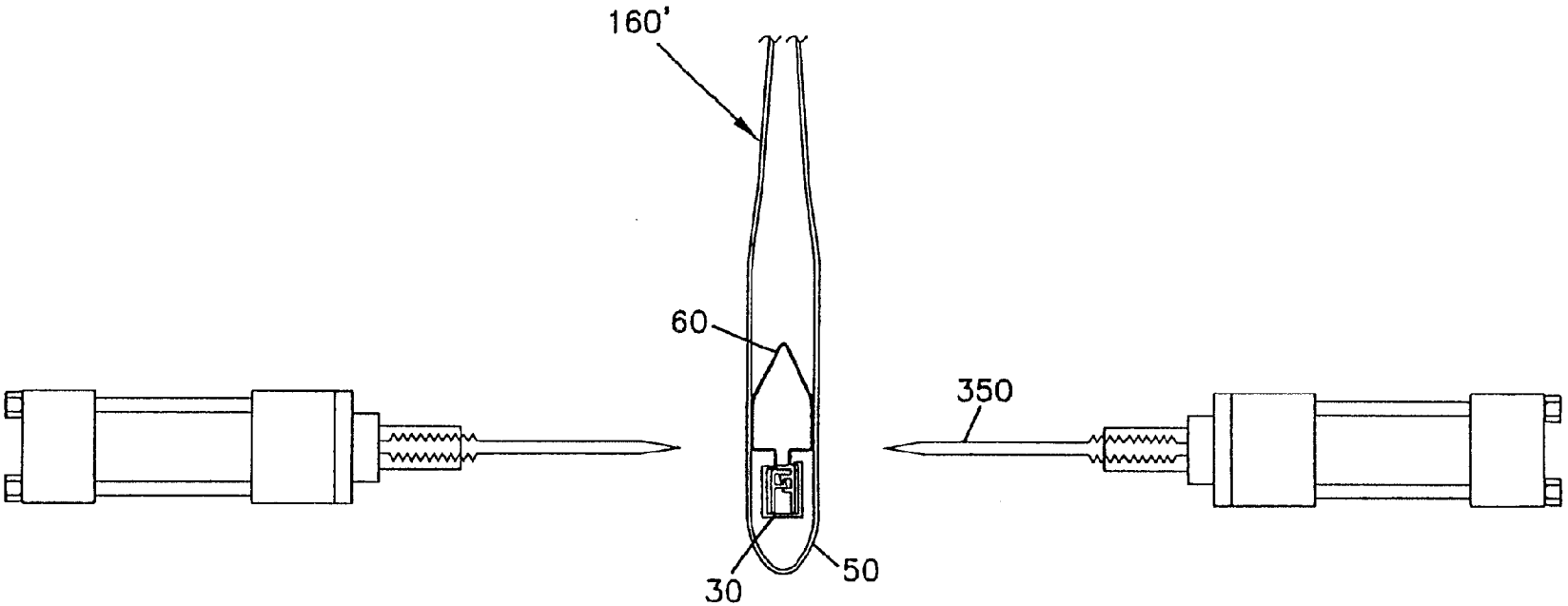
FIG. 11 is an enlarged schematic, cross-sectional view of a process for providing a perforated tamper-evident seal, such as for the package of FIG. 4.

In some embodiments, it may be desired to provide a perforated or weakened area in the film in an individual step, rather than simultaneously, with the creation of the seals. FIG. 11 illustrates unfinished package 160', similar to unfinished package 160 of FIG. 10, except that package 160' has tamper-evident structure 50 already formed prior to the package 160' reaching perforator 350. Tamper-evident seal 50 is provided by a seal bar (such as seal bar 465 of FIG. 10) and perforation is done in a subsequent step.

Figure 12:
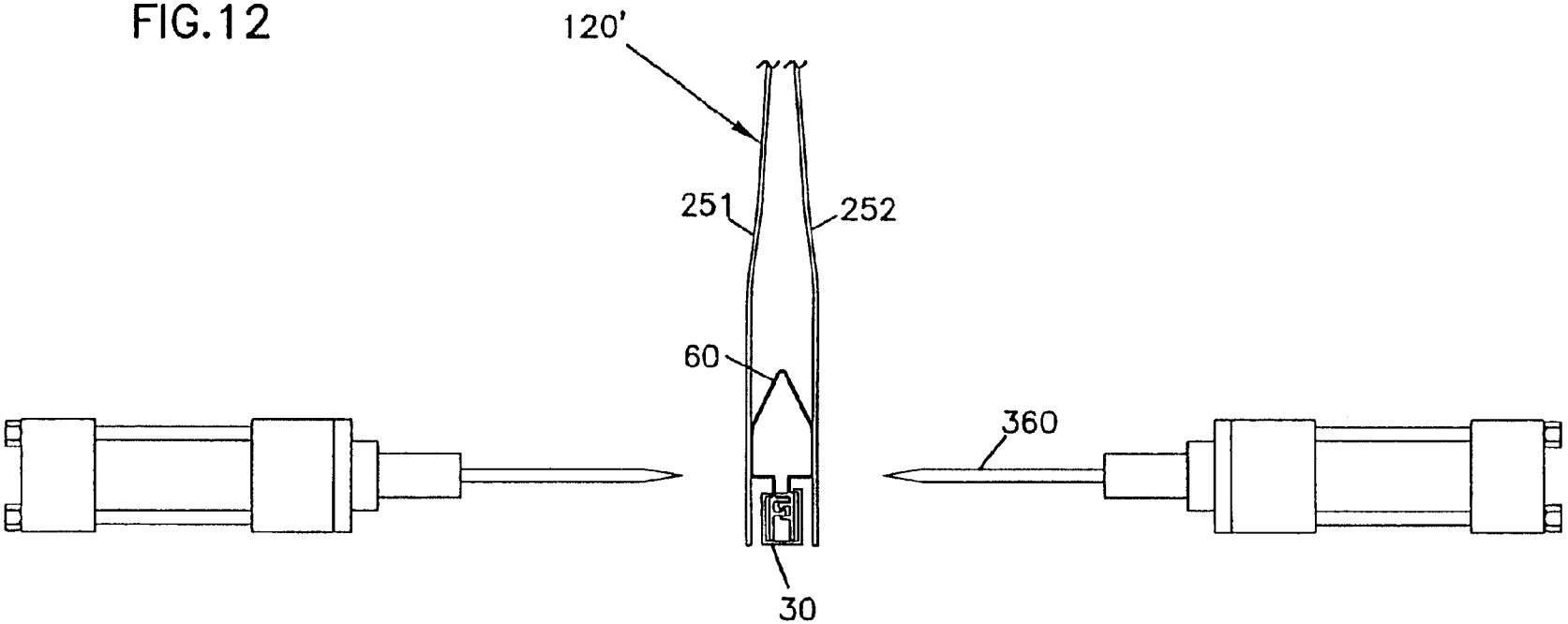
FIG. 12 is an enlarged schematic, cross-sectional view of a process for removing edges of film.

In some embodiments, no tamper-evident structure external to the slider device 30 is used; rather, only an internal tamper-evident structure 60, such as on package 120 in FIG. 4, is used. For example, FIG. 12 illustrates an unfinished package 120', similar to finished package 120 of FIG. 4. In many embodiments it is desired to minimize the amount of film present above the seal between the film halves 251, 252 and the zipper closure 20. A blade 360 may be used to slit the film and remove any undesired film.

The order of the steps for forming the seal between the zipper closure 20, the film halves 251, 252, any optional tamper-evident structure, any perforation, and the side seams 13, 15 (FIG. 1) by side seal bars 260, can be rearranged so that the zipper closure 20 is sealed to the film before the side seals are produced. Generally, any perforation is done simultaneously or subsequent to forming a tamper-evident structure.

After the side seams are made and the closed zipper closure 20 is attached, the items or material 305 (for example, cereal, snack food, fertilizer, potting soil, etc.) to be contained in the resulting package is provided by hopper 300. Hopper 300 includes valves, gates, and doors, as needed, to deposit an appropriate amount of item 305 into the package. A bottom seal bar 270 located at the top of the line is used to seal the bottom of the package and provide bottom seam 17 (FIGS. 1 through 5) once the package has been filled. A blade or knife 280 cuts the packages at the side seams to provide individual, filled packages 310.

The above specification is believed to provide a complete description of the manufacture and use of particular embodiments of the invention. Many embodiments of the invention can be made without departing from the spirit and scope of the invention.

I claim:

1. A method of making and filling a reclosable package comprising a zipper closure and a slider device, the method comprising:

(a) providing a closure construction having a first closure profile and a second closure profile;

(b) providing a slider device constructed and arranged for mounting on the closure construction and for interlocking the first closure profile with the second closure profile when the slider device is moved in a first direction, and for disengaging the first closure profile from the second closure profile when the slider device is moved in a second opposite direction;

(c) mounting the slider device onto the closure construction;

(d) after mounting the slider device onto the closure construction, attaching the closure construction with the slider device mounted thereon to first and second film panels by moving the closure construction with the slider device mounted thereon in a straight-line, the closure construction and first and second film panels forming a reclosable package having at least one unsealed seam; and (e) filling the reclosable package with an item.

2. The method according to claim 1, further comprising the step of:

(a) sealing the at least one unsealed seam after filling the reclosable package with an item.

3. The method according to claim 1, wherein the step of incorporating the closure construction with the slider device mounted thereon to first and second film panels by moving the closure construction with the slider device mounted thereon in a straight-line comprises incorporating the closure construction with the slider device mounted thereon to first mid second film panels by:

(a) passing the closure construction with the slider device mounted thereon through a slider guide positioned between the first and second film panels; and (b) forming a plurality of seals between the first and second film panels to form the reclosable package.

4. The method according to claim 3, wherein the step of passing the closure construction with the slider device mounted thereon through a slider guide positioned between the first and second film panels comprises:

(a) passing the closure construction with the slider device mounted thereon through a slider guide positioned between a film web forming the first and second film panels, the film web also forming a tamper-evident structure over the slider device to indicate whether access has been gained to the slider device.

5. The method according to claim 4, wherein the step of mounting the slider device onto the closure construction comprises:

(a) punching a notch in the closure construction; and (b) mounting the slider device within the notch in the closure construction.

6. A reclosable package made by the method according to claim 5.

7. A reclosable package made by the method according to claim 4.

8. The method according to claim 1, wherein the step of incorporating the closure construction with the slider device mounted thereon to first and second film panels comprises:

(a) sealing the first closure profile of the closure construction to the first film panel of the reclosable package and sealing the second closure profile of the closure construction to the second film panel of the reclosable package.

9. The method according to claim 8, wherein the step of incorporating the closure construction with slider device mounted thereon to first and second film panels further comprises:

(a) creating side scams by providing seals across the first film panel and the second film panel; and (b) creating a bottom seam by providing a seal between the first film panel and the second film panel, the bottom seam positioned substantially parallel to the closure construction.

10. The method according to claim 1, wherein the step of mounting the slider device onto the closure construction comprises:

(a) punching a notch in the closure construction; and (b) mounting the slider device within the notch in the closure construction.

11. A reclosable package made by the method according to claim 10.

* * * * *

UNITED STATES PATENT AND TRADEMARK OFFICE

CERTIFICATE OF CORRECTION

PATENT NO. : 6,732,491 B2
DATED : May 11, 2004
INVENTOR(S) : James E. Buchman

It is certified that error appears in the above-identified patent and that said Letters Patent is hereby corrected as shown below:

Column 8,
Line 57, insert -- and -- delete “mid”.

Column 10,
Line 5, insert -- seams -- delete “scams”.

Signed and Sealed this

Eighteenth Day of October, 2005

JON W. DUDAS
*Director of the United States Patent and Trademark Office*